US007565856B2

(12) United States Patent
Pfaff, Jr.

(10) Patent No.: US 7,565,856 B2
(45) Date of Patent: Jul. 28, 2009

(54) ROTARY CUTTING TOOL

(75) Inventor: Alan R. Pfaff, Jr., Orchard Lake, MI (US)

(73) Assignee: Eagle Rotary Systems, Inc., Jackson, MI (US)

( * ) Notice: Subject to any disclaimer, the term of this patent is extended or adjusted under 35 U.S.C. 154(b) by 246 days.

(21) Appl. No.: 11/172,644

(22) Filed: Jul. 1, 2005

(65) Prior Publication Data

US 2007/0000367 A1 Jan. 4, 2007

(51) Int. Cl.
*B26D 7/20* (2006.01)

(52) U.S. Cl. ..... 83/698.42; 83/698.51

(58) Field of Classification Search ..... 83/698.41, 83/698.42, 698.51, 698.61, 698.31, 346, 83/347; 29/895.2, 895.21, 895.3; 101/378, 101/382, 415.1

See application file for complete search history.

(56) References Cited

U.S. PATENT DOCUMENTS 3,752,042 A * 8/1973 Castille ..... 83/698.51
3,796,851 A 3/1974 Pfaff, Jr.
3,882,750 A * 5/1975 Duckett et al. ..... 83/659
4,197,154 A 4/1980 Pfaff, Jr.
5,088,367 A 2/1992 Cracchiolo et al.
5,095,830 A 3/1992 Love
5,138,923 A 8/1992 Kent et al.
5,275,076 A 1/1994 Greenwalt
5,281,511 A 1/1994 Gerhardt
5,309,792 A 5/1994 Gerhardt et al.
5,365,815 A 11/1994 Pfaff, Jr.
5,379,671 A 1/1995 Kang
5,398,580 A 3/1995 Gerhardt et al.
5,417,132 A 5/1995 Cox et al.
5,488,889 A 2/1996 Kang
5,575,185 A 11/1996 Cox et al.
5,638,733 A * 6/1997 Brazzo ..... 83/698.41
5,687,622 A 11/1997 Gerhardt
5,789,050 A 8/1998 Kang
5,797,323 A 8/1998 Beck
5,842,399 A 12/1998 Pfaff, Jr.
5,916,335 A 6/1999 Gerhardt
5,943,935 A 8/1999 Brayton et al.
6,085,626 A 7/2000 Pfaff, Jr.
6,136,209 A 10/2000 Kang (Continued)

*Primary Examiner*—Stephen Choi
(74) *Attorney, Agent, or Firm*—Robert K. Roth, Esq.; Miller, Canfield, Paddock and Stone, P.L.C.

(57) ABSTRACT

A rotary cutting tool comprises a rotary die cylinder having an axis of rotation, a pair of sides and a cylindrical surface, a die plate positioned around the cylindrical surface of the die cylinder and rigidly attached to the die cylinder at a first location, and an adjustable slide assembly operatively connecting the die plate to the die cylinder at a second location, and slidable with respect to the die cylinder between a retracted position and an extended position. The adjustable slide assembly is slidable along either a first direction around the axis of rotation of the die cylinder or a second direction parallel to the axis of rotation of the die cylinder. Adjustment of the adjustable slide assembly adjusts the position of the die plate with respect to the cylinder. The cylinder may be formed as a single piece assembly or as a first piece and a bar attached to the first piece. The bar can be machined to define in combination with the first piece the cylindrical surface.

21 Claims, 9 Drawing Sheets

U.S. PATENT DOCUMENTS 6,178,852 B1 1/2001 Pfaff
6,223,641 B1 5/2001 Kang
6,681,666 B2 1/2004 Pfaff, Jr.
6,694,878 B2 * 2/2004 Pezzetta et al. ..... 101/415.1
6,779,426 B1 8/2004 Holliday
6,792,840 B2 9/2004 Myers et al.
6,845,700 B2 * 1/2005 Capdeboscq ..... 83/698.42
2005/0120857 A1 6/2005 Pfaff, Jr.

* cited by examiner

ROTARY CUTTING TOOL

FIELD OF THE INVENTION

This invention relates to improvements in rotary cutting tools, and more particularly to improvements in control of the position of a die plate on the rotary cutting tool.

BACKGROUND OF THE INVENTION

Rotary cutting tools are useful for cutting thin material such as, for example, paper, paperboard, cardboard, plastic film, metal foil, thin sheet metal, etc. Generally a stream of paperboard or other thin material is fed between a pair of rotating cylinders. The thin material may be received on a large roll and then fed between the rotating dies. The cylinders have cutting surfaces which cut the thin material as it streams between the cylinders, allowing for high volume production of cut blanks. Rotary cutting tools include solid rotary dies, where the cutting surface is made part of the cylinders, and flexible rotary dies, where a die plate is wrapped around a cylinder.

It is important that the die plates of flexible dies be properly affixed to the cylinder and aligned, both with respect to the cylinder and with respect to each other. This is especially important given the speed of rotation of the die cylinders associated with high volume production. Known techniques for affixing and aligning the die plates include forming the die plate and die cylinders out of a magnetic material so that they are magnetically attracted to one another. However, such a design greatly increases the costs of the die cylinders.

U.S. patent application Ser. No. 10/730,580, assigned to the assignee of the present application, discloses a highly advantageous design for a rotary cutting tool where eccentrics are used for position adjustment of the die plate. It would be highly desirable to provide a rotary tool having an improved retaining and adjustment mechanism for use with eccentric position adjustment.

SUMMARY OF THE INVENTION

In accordance with a first aspect, a rotary cutting tool comprises a rotary die cylinder having an axis of rotation, a pair of sides and a cylindrical surface, a die plate positioned around the cylindrical surface of the die cylinder and rigidly attached to the die cylinder at a first location, and an adjustable slide assembly operatively connecting the die plate to the die cylinder at a second location, and slidable with respect to the die cylinder between a retracted position and an extended position. The adjustable slide assembly is slidable along either a first direction around the axis of rotation of the die cylinder or a second direction parallel to the axis of rotation of the die cylinder. Adjustment of the adjustable slide assembly adjusts the position of the die plate with respect to the cylinder. The cylinder may be formed as a single piece assembly or as a first piece and a bar attached to the first piece. The bar can be machined to define in combination with the first piece the cylindrical surface.

From the foregoing disclosure and the following more detailed description of various preferred embodiments it will be apparent to those skilled in the art that the present invention provides a significant advance in the technology of rotary cutting tools. Particularly significant in this regard is the potential the invention affords for providing a high quality, low cost rotary cutting tool. Additional features and advantages of various preferred embodiments will be better understood in view of the detailed description provided below.

Figure 1:
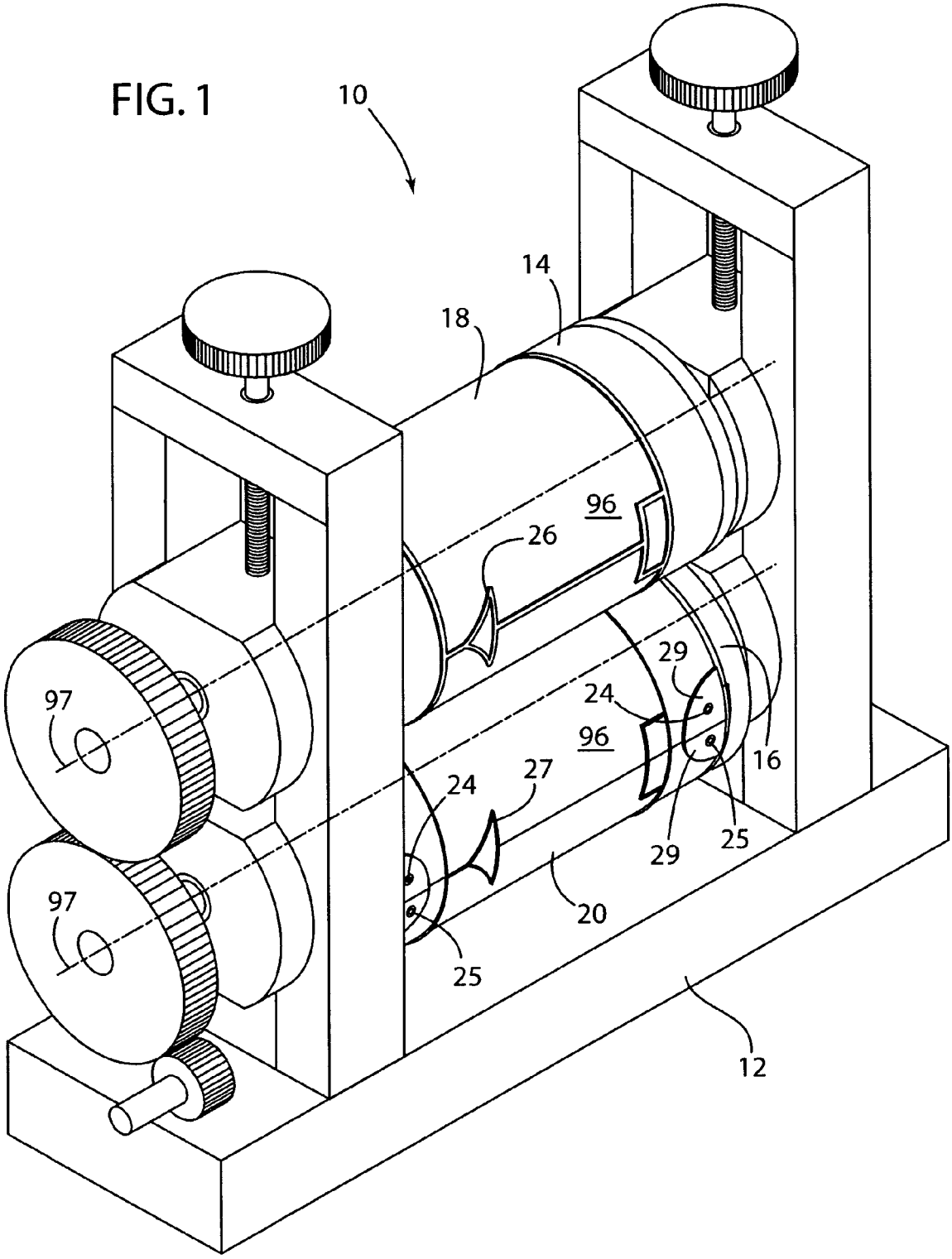
FIG. 1 is a perspective view of a rotary cutting tool in accordance with a preferred embodiment, showing the die plates indexed with respect to one another.

It should be understood that the appended drawings are not necessarily to scale, presenting a somewhat simplified representation of various preferred features illustrative of the basic principles of the invention. The specific design features of the rotary cutting tool as disclosed here, including, for example, the specific dimensions of the eccentrics, will be determined in part by the particular intended application and use environment. Certain features of the illustrated embodiments have been enlarged or distorted relative to others to help with clear understanding. In particular, thin features may be thickened, for example, for clarity of illustration. All references to direction and position, unless otherwise indicated, refer to the orientation illustrated in the drawings.

DETAILED DESCRIPTION OF CERTAIN PREFERRED EMBODIMENTS

It will be apparent to those skilled in the art, that is, to those who have knowledge or experience in this area of technology, that many uses and design variations are possible for the rotary cutting tool disclosed here. The following detailed discussion of various alternative and preferred features and embodiments will illustrate the general principles of the invention with reference to a rotary cutting tool suitable for use in industrial applications where flat paper-like materials are to be cut. Other embodiments suitable for other applications will be apparent to those skilled in the art given the benefit of this disclosure.

Referring now to the drawings, in FIG. 1 shows a rotary cutting tool 10 in accordance with a preferred embodiment. Rotary die cylinders 14, 16 each have an axis of rotation 97 and are mounted on a stand 12 so that the cylinders 14, 16 come into close proximity with one another. Wrapped around each die cylinder is a corresponding die plate 18, 20. Each die plate has cutting blades 26, 27 rising above and thicker than a base surface 96. When a thin material is fed between the die plates, the blades rotate with the cylinders, cut the thin material, and the thin material is then removed from the cutting area. In certain preferred embodiments one die plate may have a cutting blade 26 and the other die plate may have a counter element 27 which cooperates with the blade to cut the thin material into cut blanks.

Each die plate is a generally rectangular piece, often a flexible metal. The top die plate 18 wraps around the cylindrical surface 19 (shown in FIG. 2) of die cylinder 14, and the bottom die plate 20 wraps around the corresponding cylindrical surface of die cylinder 16. Each die plate is mounted on its corresponding die cylinder at four locations generally adjacent the four corners 29 of each die plate. Preferably the four corners 29 of the die plate are reinforced by having a larger thickness than the surrounding base surface 96, as seen in FIG. 1. Once wrapped around the cylinders, a pair of die plate corners 29 are positioned generally adjacent one another. The die plates 18, 20 may preferably be offset from one another to allow space for the thicker corners as they rotate. In the preferred embodiment shown in FIG. 1, the offset is 180 degrees. That is, the corners are located 180 degrees apart from one another so that as they rotate about their respective cylinder the die corners of one die plate 18 do not meet the die corners of the second die plate 20.

The position of the die plates 18, 20 with respect to the corresponding die cylinders 14, 16 is adjustable at one or more of these mounting locations. In the preferred embodiment shown in the drawings the die plates are provided with four openings 22, one at each corner. Into each of these openings extends a fastener such as a pin 24 or set screw 25 which helps secure the die plate to the die cylinder. Two of the openings 22 receive a pin 24 which is attached to the cylinder at openings 66 (shown in FIG. 2), providing a fixed mounting and reference location. The other two openings 22 allow a set screw 25 to extend into an adjustable slide assembly, allowing for an adjustable mounting location as discussed in further detail below. Adjustable mounting locations for some of the fasteners are highly desirable in that they help position the die plate on the cylinder without buckling or irregular surfaces, and allow for precise alignment of the die plates with respect to one another. Other combinations of fasteners, fixed mounting locations and adjustable mounting locations will be readily apparent to those skilled in the art given the benefit of this disclosure.

Figure 2:
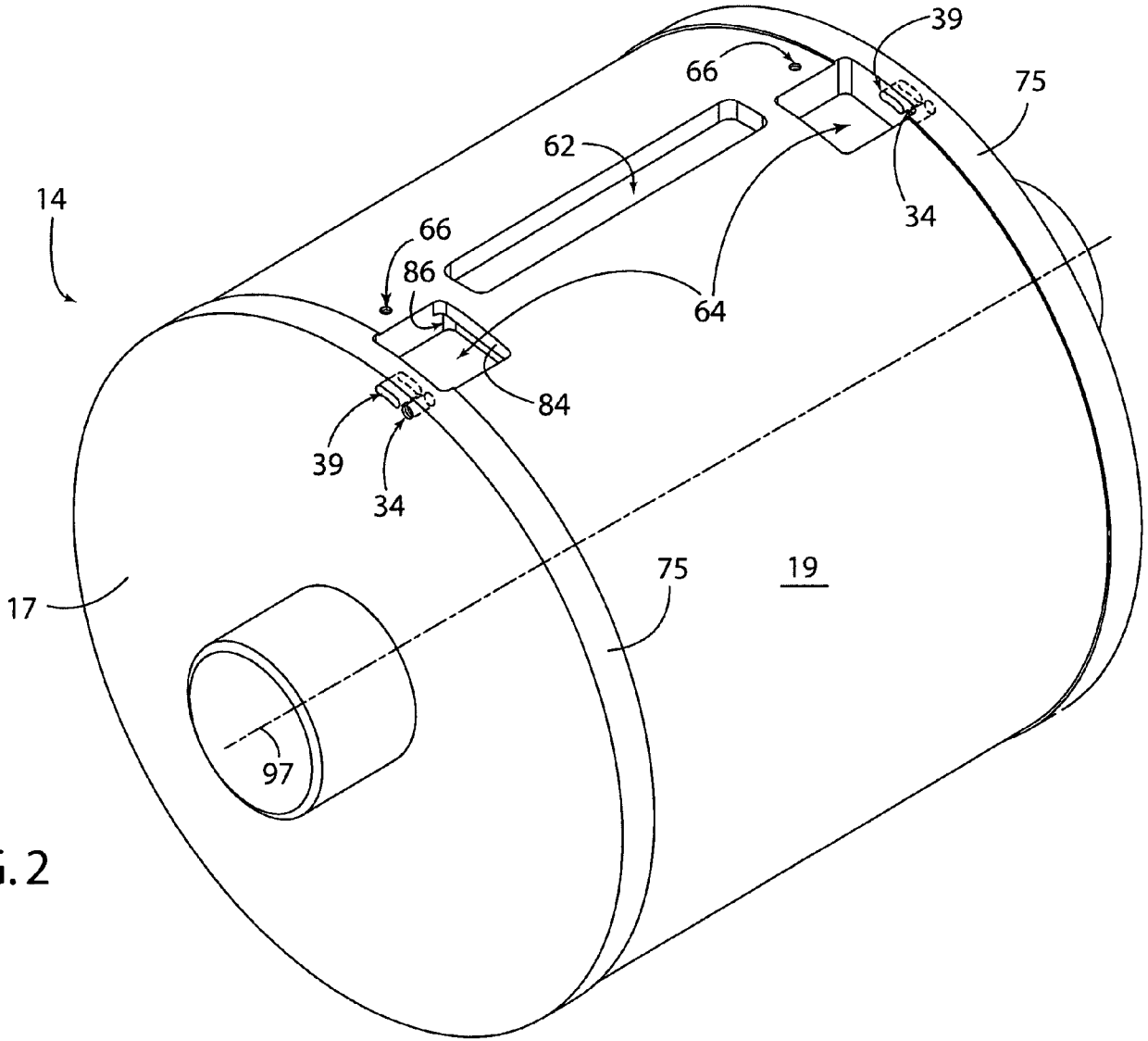
FIG. 2 is an isolated perspective view of one of the die cylinders in accordance with the preferred embodiment of FIG. 1.

FIG. 2 shows a first preferred embodiment of the die cylinder 14, having a cylindrical surface 19 with a constant radius about an axis of rotation 97. Two sides 17 extend from either end of the cylindrical surface 19 (only one side is visible in the perspective view of FIG. 2) generally perpendicular to the axis of rotation and to the cylindrical surface. A pair of pockets 64 are provided in the cylindrical surface of the cylinder 14, and have undercuts 86 beneath overhangs 84 so as to be sized to receive adjustable slide assemblies as discussed in greater detail below. A first opening 39 and a second opening 34 are positioned on each side 17, and connect to the corresponding pocket 64. In certain preferred embodiments the openings 39 and 34 may be formed as a single opening. Openings 66 on the cylindrical surface 19 of the die cylinder 14 are sized to receive pins for securing a die plate to the cylinder. Optional elongate recess 62 is shown, running generally parallel to the axis of rotation 97. A magnet 60 may be placed in the elongate recess 62 (seen in FIG. 3). The magnet may be used to temporarily hold the die plate 18 until the final die plate position is set by movement of the adjustable slide assembly. Bearer surfaces 75 may be provided, extending radially around the axis of rotation a little beyond the cylindrical surface. The bearer surfaces can engage bearer surfaces on an adjacent cylinder and thereby act as protection for the cutting surfaces of the die plates.

Figure 3:
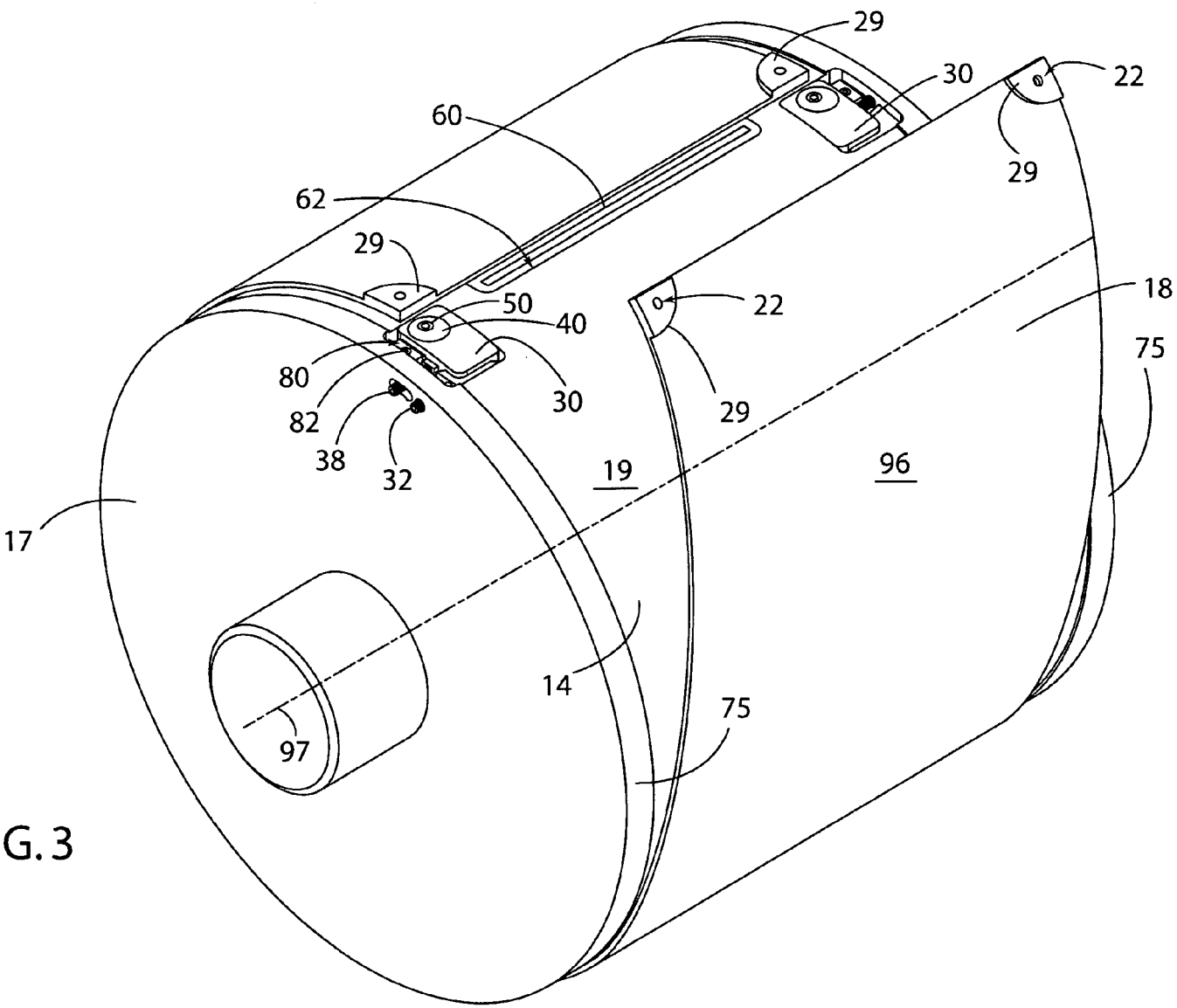
FIG. 3 is a perspective view of one die cylinder, showing the die plate partially unwrapped.

FIG. 3 shows a die plate 18 with the cutting surfaces removed, leaving only the die corners 29 and the base surface 96. The die plate is partially unwrapped around a die cylinder 14, revealing a pair of adjustable slide assemblies, each residing in a pocket 64. Each adjustable slide assembly preferably comprises an adjustable slide 30, first eccentric 40, second eccentric 50, and various other elements as described in greater detail below. The adjustable slides are attached to the die plates remote from the cutting surfaces of the die plates. More specifically, as shown in the Figs., the adjustable slides are positioned on the underside of the die plate, the side opposite the side of the die plate with the cutting surfaces. In the embodiment shown in the drawings, pair of fixed pins secure the die plate and a pair of set screws is attached to a pair of adjustable slide assemblies slidable along the Y-axis. Alternatively, one of the fixed pins may be replaced with an adjustable slide assembly slidable along the X-axis, if needed.

Figure 4:
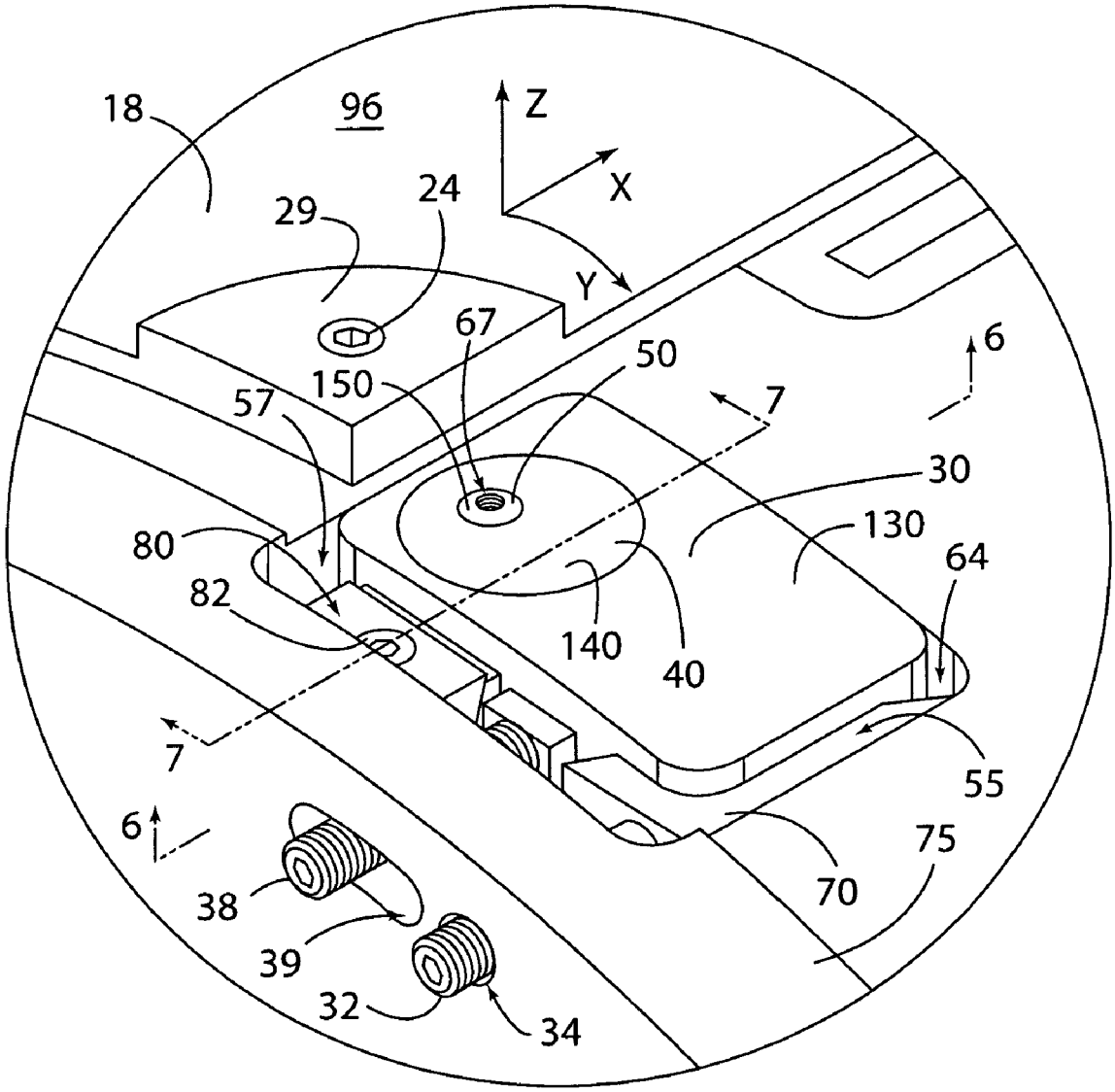
FIG. 4 is an isolated perspective view focusing on one of the adjustable slides.

FIG. 4 is a close-up view of one of the adjustable slide assemblies. Preferably the die plates are adjustably captivated to the die cylinder in the pocket. Adjustably captivated, as used herein means that the motion of one part with respect to another part is partially restricted. For example, the adjustable slide 30 is free to slide back and forth with respect to the die cylinder around the axis of rotation of the die cylinder (along the Y-axis labeled in FIG. 4). However, the adjustable slide is captivated so that it is held in the pocket, and cannot leave the pocket along the Z-axis. In a similar manner the outer eccentric 40 is adjustably captivated to the slide 30, and the inner eccentric 50 is adjustably captivated to the outer eccentric 40.

The pocket 64 is preferably oversized, in the sense that the adjustable slide 30 in inserted into the pocket and leaves a gap 55 for adjustment along the Y-axis, and a gap 57 along the X-axis. The surfaces 130, 140, 150 of the slide, first eccentric and second eccentric, respectively, are preferably flush with the cylindrical surface 19. That is, these surfaces may be machined down to share a common radius with the cylindrical surface 19 of the die cylinder 14. An eccentric adjustment screw 38 extends through first opening 39 on the side wall to urge the outer eccentric 40 to rotate with respect to the adjustable slide. A wedge adjustment screw 32 extends through second opening 34 and engages a wedge 70 to urge the adjustable slide along the Y-axis. First opening 39 and second opening 34 may alternatively be formed as a single opening.

Figure 7:
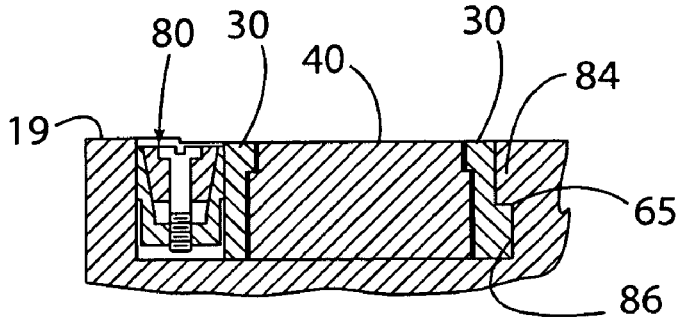
FIG. 7 is a cross section view taken along line 7-7 in FIG. 4, showing how the adjustable slide is slidably secured to the die cylinder.

A clamp 80 (adjustable by screw 82) fills up gap 57, urging the slide 30 against one wall of the pocket 64. FIG. 7 shows the adjustable slide 30 captivated in the pocket after adjustment. Slide 30 has a catch 65 which projects into an undercut 86 of the pocket. Overhang 84 prevents dislocation of the slide along the Y-axis. However, when the clamp is unclamped, the slide may be slidable along the Y-axis between an extended position and a retracted position, while still being captivated by the overhang 84.

Figure 5:
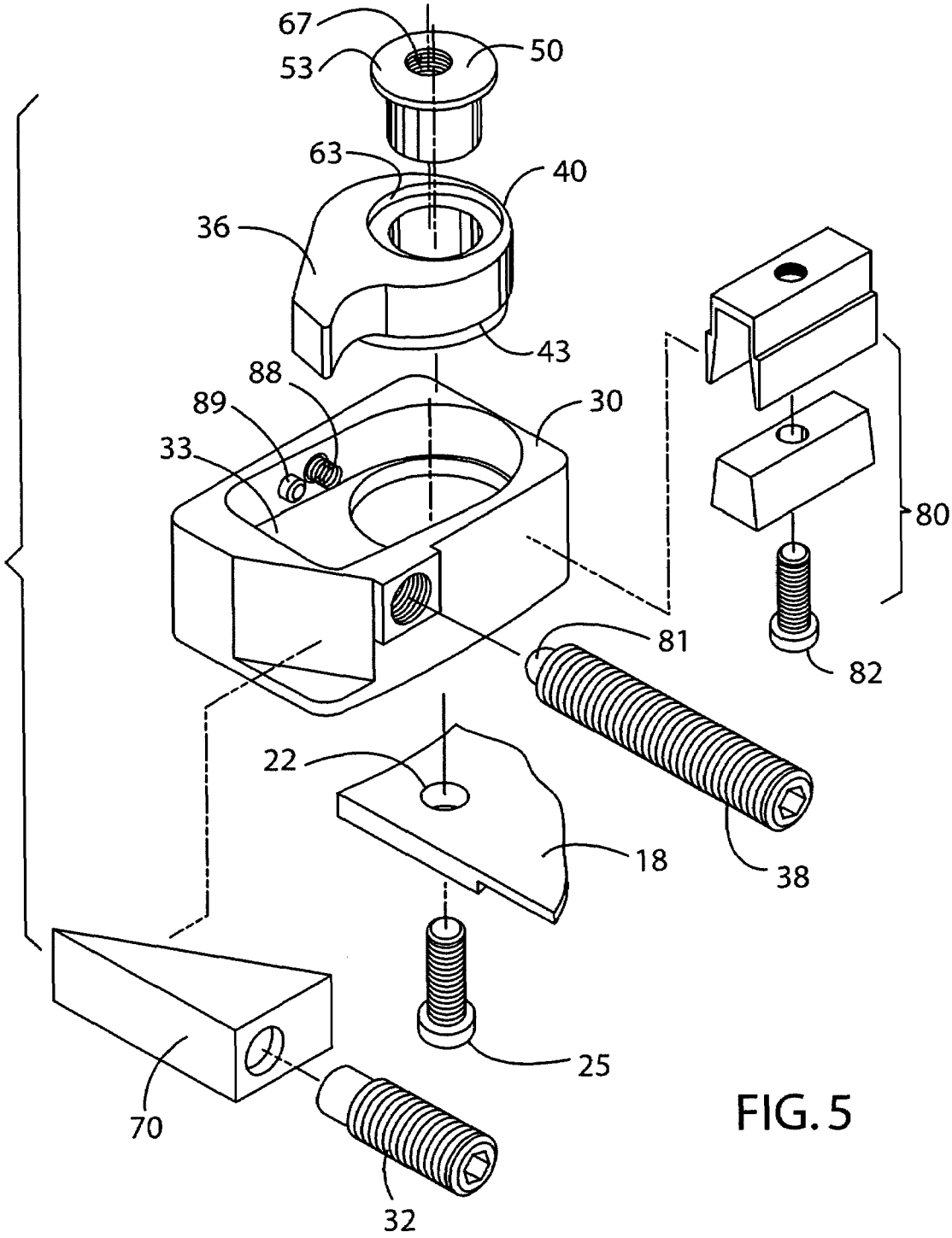
FIG. 5 is an exploded perspective view of the adjustable slide shown from the underside.
Figure 6:
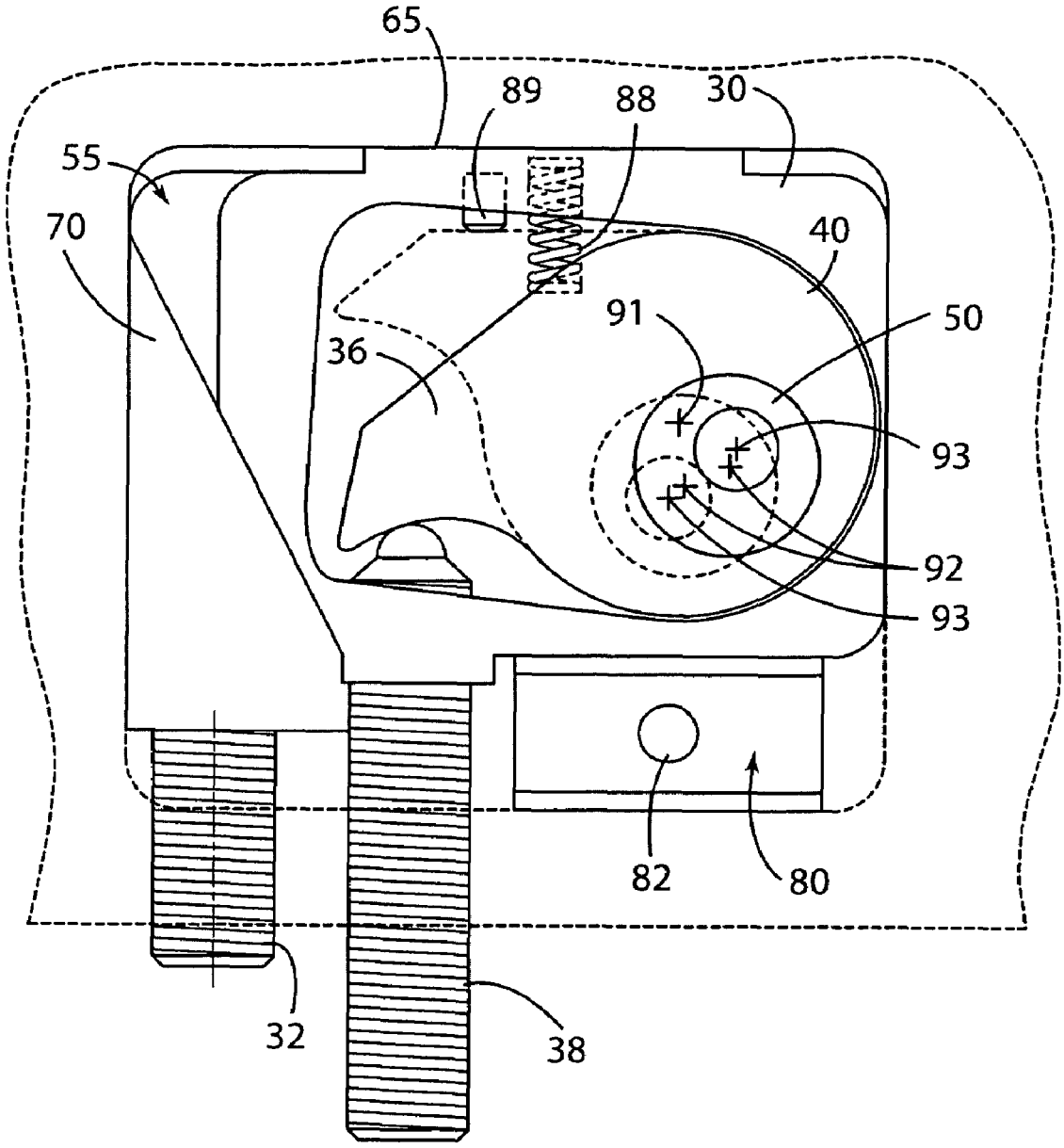
FIG. 6 is a cross section, underside view of the adjustable slide assembly taken through line 6-6 in FIG. 4, and shows a range of motion of the external eccentric in response to adjustment of the eccentric set screw.

FIG. 5 is an exploded perspective view of the adjustable slide assembly, taken from the underside as viewed in FIG. 4. FIG. 6 also shows the adjustable slide assembly taken from the underside, but along line 6-6 in FIG. 4. Wedge 70 and clamp 80 cooperate to secure the position of the adjustable slide 30. The outer eccentric sits in a cavity in the adjustable slide. Eccentric engagement screw 38 has a round end 81 which engages wing 36 on the outer eccentric 40. The outer eccentric is also provided with a shoulder 43 which engages top wall 33 of the adjustable slide. Similarly, a shoulder 53 on the smaller eccentric 50 engages a counterbore 63 in the larger eccentric 40. Opening 67 in the small eccentric 50 receives screw 25, as well as opening 22 in the die plate. The die plate 18 is captivated between the screw 25 and the slide 30 so that the die plate is adjusted by adjustment of the adjustable slide assembly. Optionally a return spring 88 and/or a hard stop 89 may be provided, mounted on the slide. The stop is a hard stop for the large eccentric, and the return spring provides a biasing force against the outer eccentric to help the eccentric move.

FIG. 6, with the eccentrics viewed from the underside, shows a range of motion for the eccentrics after the adjustable slide has been clamped into a fixed position. The large eccentric rotates about a first axis 91 over a travel range of about 60-70 degrees from a fully released position in the preferred embodiment shown in the drawings. The inner eccentric 50 rotates about a second axis 92, defined by the opening in the large eccentric to be offset from the first axis. Thus, rotation of the large eccentric 40 moves the second axis 92 with respect to the first axis 91 about an arcuate vector. The fastener 25 (which is attached to the die plate) is positioned in an opening in the inner eccentric 50 so as to be movable about a third axis 93, offset from both the first axis 91 and the second axis 92. The third axis 93 is rotatable with respect to the second axis about another arcuate vector. Since the die plate travels with the third axis, this combination of eccentrics advantageously allows for fine position adjustment of the die plate. That is, the range of adjustment of the die plate due to adjustment of the eccentrics is the resultant of two arcuate vectors. Use of the eccentrics to create such elegant position adjustment advantageously eliminates the need for incorporating magnetic materials into the die cylinder, the die plate or both. Further, use of such eccentrics provides a range of positions to accommodate positional error in the adjustable slide which receives the eccentrics and positional error in the die plate locating holes 22.

Attachment of the die plate to the die cylinder can be accomplished in the following manner. First, the die plate 18 is attached to the cylinder 14 with the one or more fixed mounting pins 24 at openings 66. As noted above, the inner eccentric is adjustably captivated by the outer eccentric, and the outer eccentric is adjustably captivated by the adjustable slide, and the adjustable slide is adjustably captivated by the overhang 84 cooperating with the catch 65. The adjustable slide 30 is inserted into the pocket 64 and retracted to its fully retracted position. The clamp 80 is loose. The outer eccentric 40 is rotated to the fully released position, shown with solid lines in FIG. 6. Fastener 25 is then attached to the inner eccentric, sandwiching the die plate between the fastener and the adjustable slide 30. The die plate 18 is now attached to the adjustable slide 30, but the slide is adjustable along the Y-axis and the X-axis. Rotation of the wedge set screw 32 moves the wedge 70 against the adjustable slide, urging the adjustable slide to a forward position. The forward position is limited by the amount of gap 55 between the adjustable slide and the die cylinder 14. Movement of the adjustable slide 30 to a forward position acts to tighten the die plate around the cylinder. This step is repeated at each adjustable slide used.

Next, the set screw 38 engaging the outer eccentric wing 36 is rotated, urging the outer eccentric to rotate away from the released position. The eccentrics 40, 50 cooperate not only to provide a range of adjustment of the die plate, but also maintain tension in the die plate once set to a desired position. Once the desired position of the eccentrics is achieved, accounting for all the various tolerances and minor misalignments, the clamp 80 engaged, typically with an alien wrench turning screw 82, taking up the gap 57 in the pocket 64, and locking down the slide 30 so it can no longer move with respect to the die cylinder.

Figure 8:
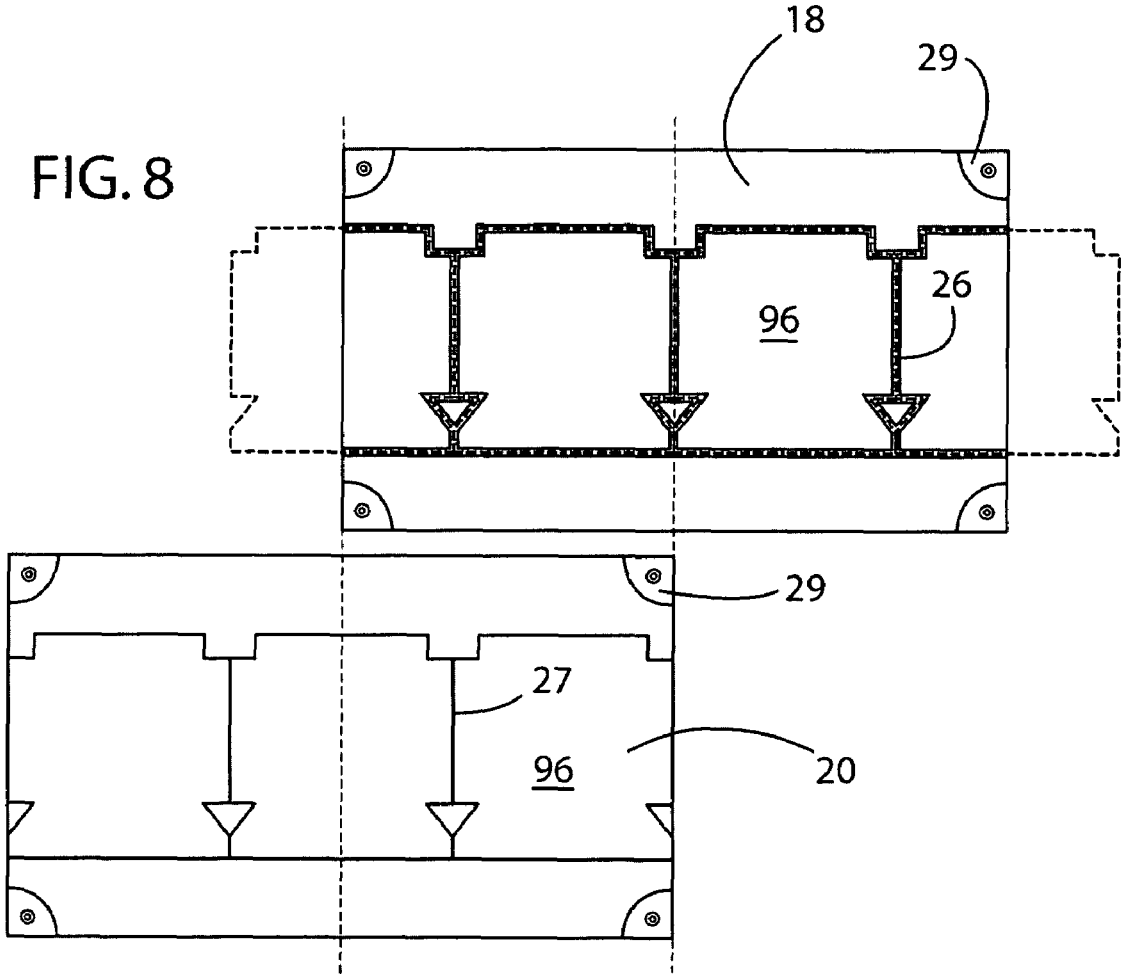
FIG. 8 is a schematic showing a pair of die plates treated as flat surfaces, each offset from one another to allow space for the thick die plate corners and to account for the offset in the cut blank shape defined by the cutting surfaces.

When wrapped around the die cylinders, the die plate corners 29 are positioned generally along a line parallel to the axis of rotation of the respective cylinder, as shown in FIG. 1. FIG. 8 shows die plates 18 and 20 unwrapped from their respective die cylinders, but still held in position with respect to one another. In accordance with a highly advantageous feature, the corners 29 of the die plates are offset from one another so that the thicker corners do not meet as the cylinders rotate. That is, the first die plate meets the thin material to be cut at a first location or surface, the second die plate meets the thin material at a second location or surface, directly opposite the first location and these surfaces of the die plate cooperate to cut the thin material. When the four corners of the first die plate are at the first location, the four corners of the second die plate are offset from the second location. In the preferred embodiment shown in the Figs., the die plates are offset by 180 degrees, and the pattern of cutting surfaces 26, 27 for the cut blanks are offset from one another to compensate for the offset positioning on the die cylinders. Each die corner and fastener is positioned opposite a relieved area on the opposing die plate. Also, because the die plate patterns of cutting surfaces for the cut blanks are identical, it is possible to use the offset to place a parting line of each die plate pattern opposite an area where no parting line exists to produce a cleaner and relatively uninterrupted cut and crease effect on the part produced.

Figure 9:
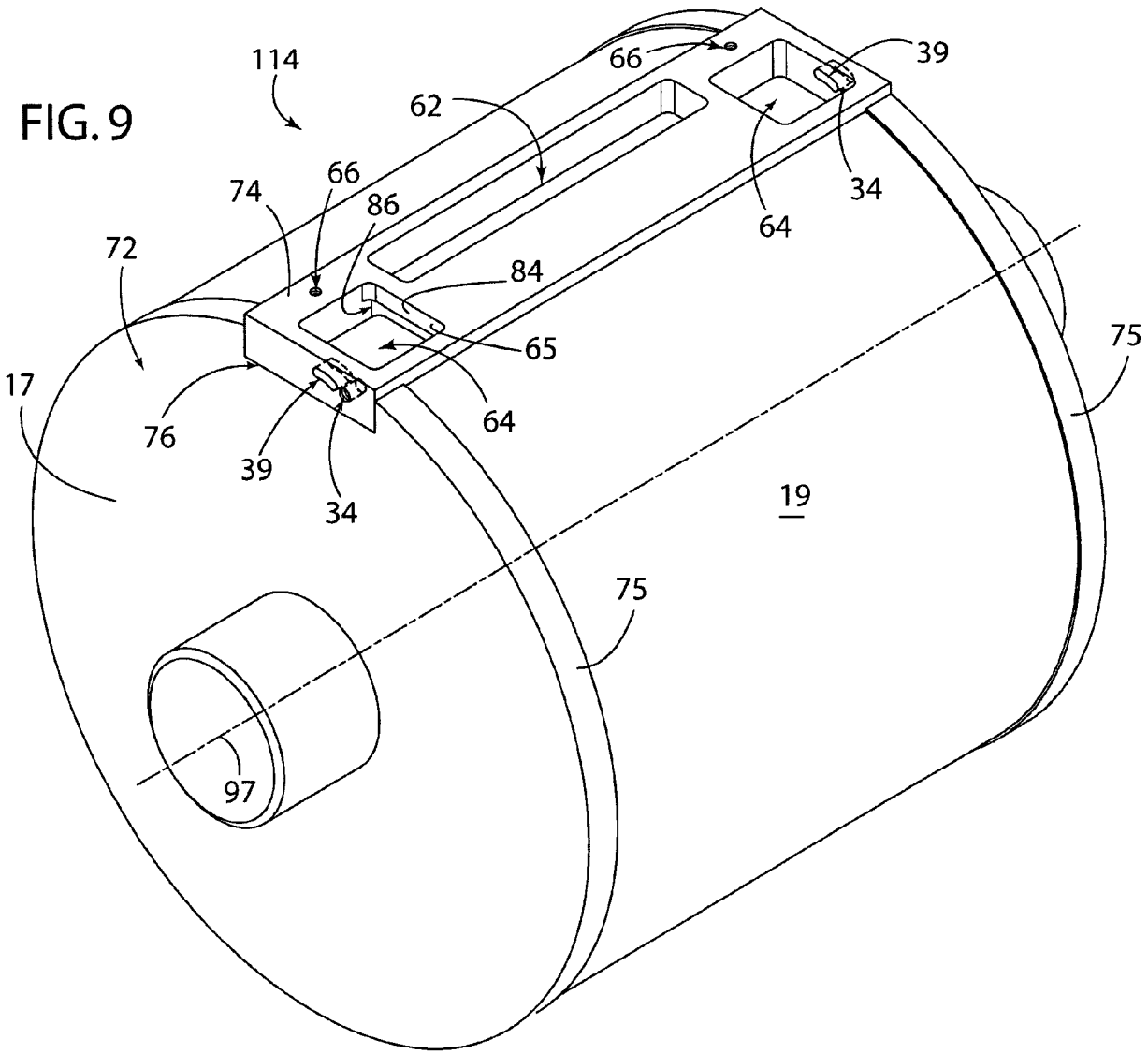
FIG. 9 is a perspective view of a die cylinder in accordance with another preferred embodiment where a single slot is machined into the cylinder and the adjustment and attachment elements are mounted on a bar.
Figure 10:
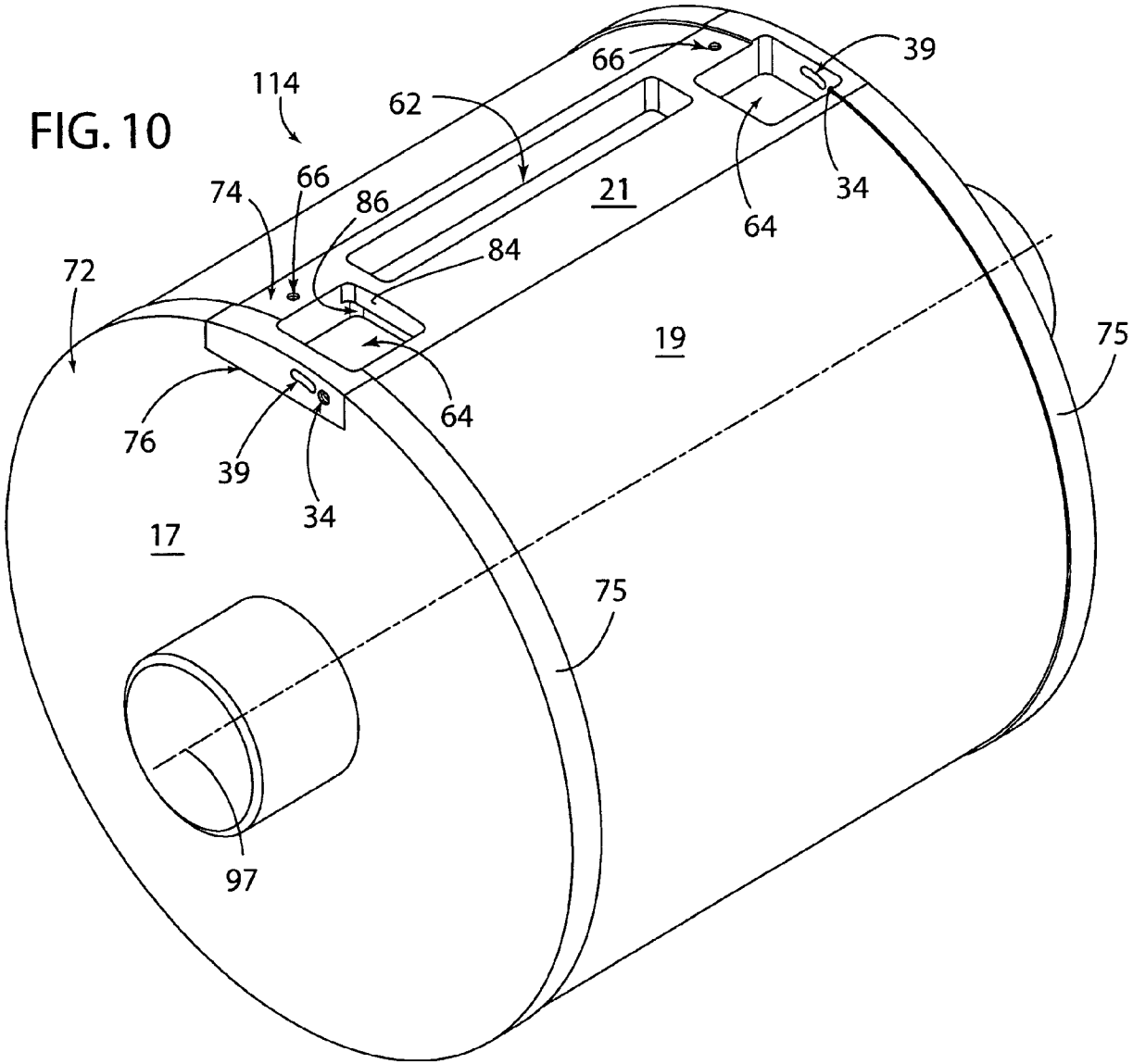
FIG. 10 is a view of the die cylinder of FIG. 8 after a top surface of the bar and the die cylinder has been ground to a uniform outside diameter.

FIGS. 9-10 show another preferred embodiment, where the cylinder 114 is formed as a two piece construction, a first piece 72 and a bar 74 having a top surface 21. The first piece 72 of the cylinder has a slot 76 machined into it, preferably with square sides and a square bottom. The cylindrical surface 19 typically does not extend to the top surface 21. In accordance with a highly advantageous feature of the invention, all of the adjustment and attachment elements for the die plates may be machined and attached to the bar 74. Further, the bar 74 can be sized to accommodate a wide variety of die cylinder sizes, and then the top surface 21 may be ground down with the first piece 72 of the cylinder 114 so that the top surface shares the same radius (about axis 97) as cylindrical surface 19. Thus, there is provided a constant diameter across both the first piece 72 and the bar 74, as shown in FIG. 10.

From the foregoing disclosure and detailed description of certain preferred embodiments, it will be apparent that various modifications, additions and other alternative embodiments are possible without departing from the true scope and spirit of the invention. The embodiments discussed were chosen and described to provide the best illustration of the principles of the invention and its practical application to thereby enable one of ordinary skill in the art to use the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A rotary cutting tool comprising, in combination:

a rotary die cylinder having an axis of rotation, a pair of sides and a cylindrical surface;

a die plate positioned around the cylindrical surface of the die cylinder and rigidly attached to the die cylinder at a first location; and at least one adjustable slide assembly operatively connecting the die plate to the die cylinder at a second location, and slidable with respect to the die cylinder between a retracted position and an extended position;

wherein the adjustable slide assembly is slidable along both a first direction around the axis of rotation of the die cylinder and a second direction parallel to the axis of rotation of the die cylinder, while being securely attached to the die cylinder;

wherein adjustment of the at least one adjustable slide assembly adjusts the position of the die plate with respect to the cylinder.

2. The rotary cutting tool of claim 1 wherein the at least one adjustable slide assembly comprises an adjustable slide adjustably captivated to the die cylinder.

3. The rotary cutting tool of claim 2 wherein the adjustable slide is positioned in a pocket in the die cylinder and has a catch, and the die cylinder has an overhang defining an undercut in the pocket which slidably receives the catch.

4. The rotary cutting tool of claim 3 further comprising a clamp moveable between a clamped position and an unclamped position, and located in the pocket adjacent the adjustable slide, wherein the clamp in the clamped position cooperates with the overhang to resist movement of the adjustable slide.

5. The rotary cutting tool of claim 2 wherein the adjustable slide assembly further comprises a first eccentric adjustably captivated by the adjustable slide, and rotatable with respect to the adjustable slide about a first axis.

6. The rotary cutting tool of claim 5 wherein the adjustable slide has a top and the first eccentric has a shoulder which resists movement of the first eccentric in a direction away from the axis of rotation of the die cylinder.

7. The rotary cutting tool of claim 5 further comprising a second eccentric rotatable with respect to the adjustable slide about a second axis offset from the first axis.

8. The rotary cutting tool of claim 7 further comprising a fastener mounted on the second eccentric along a third axis offset from the first axis and the second axis, wherein the adjustable die plate is adjustably captivated between the adjustable slide and the fastener.

9. The rotary cutting tool of claim 7 wherein the second eccentric has a shoulder which engages the first eccentric to resist movement of the second eccentric in a direction away from the axis of rotation of the die cylinder.

10. The rotary cutting tool of claim 2 further comprising a first eccentric rotatable with respect to the adjustable slide, wherein the adjustable die plate is operatively connected to the first eccentric so that rotation of the first eccentric adjusts the position of the die plate; and a screw engaging the first eccentric, wherein rotation of the screw urges rotation of the first eccentric.

11. The rotary cutting tool of claim 10 wherein the screw engages a wing on the first eccentric.

12. The rotary cutting tool of claim 10 wherein the adjustable slide is positioned in a pocket in the die cylinder, and further comprising a first opening in the side of the die cylinder connected to the pocket, wherein the screw is positioned in the first opening.

13. The rotary cutting tool of claim 2 further comprising a wedge which abuts against the adjustable slide, wherein movement of the wedge urges the adjustable slide assembly to move between the retracted position and the extended position.

14. The rotary cutting tool of claim 13 wherein the adjustable slide is positioned in a pocket in the die cylinder, and further comprising a wedge adjustment screw extending through a second opening in the side of the die cylinder connected to the pocket.

15. The rotary cutting tool of claim 1 further comprising a second die cylinder and a second die plate wrapped around the second die cylinder, wherein both die cylinders are mounted on a stand, and the second die plate cooperates with the first die plate to cut a thin material inserted between the die plates.

16. The rotary cutting tool of claim 15 wherein the first die plate and the second die plate each have four corners, the first die plate meets the thin material at a first location, the second die plate meets the thin material at a second location, and when the four corners of the first die plate are at the first location, the four corners of the second die plate are offset from the second location.

17. The rotary cutting tool of claim 1 wherein the die cylinder has an elongate recess positioned on the cylindrical surface of the cylinder and parallel to the axis of rotation, wherein the elongate recess is adapted to receive a magnet.

18. The rotary cutting tool of claim 17 further comprising a magnet received in the elongate recess in the die cylinder, wherein corners of the die plate are positioned generally along a line parallel to the axis of rotation, and the magnet is positioned underneath the die plate generally adjacent the line defined by the corners of the die plate.

19. The rotary cutting tool of claim 1 wherein the die cylinder comprises a first piece having a slot, and a bar attached at the slot, and the first piece and the bar have an external cylindrical surface of the same radius.

20. The rotary cutting tool of claim 1 wherein the die cylinder has openings adapted to receive fasteners, and fasteners secured to the openings fixedly secure the die plate to the die cylinder at at least one location.

21. A rotary cutting tool comprising, in combination:

a rotary die cylinder having an axis of rotation, a pair of sides and a cylindrical surface;

a die plate having cutting surfaces, positioned around the cylindrical surface of the die cylinder and rigidly attached to the die cylinder at a first location; and at least one adjustable slide assembly slidable with respect to the die cylinder between a retracted position and an extended position, wherein the at least one adjustable slide assembly continuously engages the die plate;

wherein the adjustable slide assembly is slidable along both a first direction around the axis of rotation of the die cylinder and a second direction parallel to the axis of rotation of the die cylinder, while being securely attached to the die cylinder;

wherein the adjustable slide assembly is attached to the die plate remote from the cutting surfaces, the adjustable slide assembly is attached to the rotary die cylinder, and adjustment of the adjustable slide assembly adjusts the position of the die plate with respect to the cylinder.

* * * * *